US006164451A

United States Patent [19]

Sherman

[11] Patent Number: 6,164,451

[45] **Date of Patent: *Dec. 26, 2000**

[54] COSMETICS CASE

[75] Inventor: Patricia McEvoy Sherman, New York, N.Y.

[73] Assignee: Trish McEvoy, Ltd., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/039,658

[22] Filed: Mar. 16, 1998

[51] Int. Cl.[7] ..... B65D 69/00

[52] U.S. Cl. ..... 206/581; 206/472; 206/823

[58] Field of Search ..... 206/581, 472, 206/473, 823, 425; 150/106, 113; 220/DIG. 26; D3/319

[56] References Cited

U.S. PATENT DOCUMENTS

| | | | |
|---|---|---|---|
| D. 80,169 | 12/1929 | Danco . | |
| D. 151,950 | 12/1948 | Anderson . | |
| D. 183,711 | 10/1958 | Blaivas | D9/3 |
| 343,073 | 6/1886 | Seefels . | |
| D. 346,692 | 5/1994 | Bromell . | |
| 364,623 | 6/1987 | Beidler | D3/319 |
| D. 385,694 | 11/1997 | Magnussen . | |
| 839,529 | 12/1906 | Weissbrod . | |
| 1,464,176 | 8/1923 | Freund . | |
| 1,600,633 | 9/1926 | Hildebrand . | |
| 1,666,652 | 4/1928 | Hiering | 26/581 |
| 1,999,669 | 4/1935 | Smith . | |
| 2,000,302 | 5/1935 | Solomon . | |
| 2,038,319 | 4/1936 | Stanley . | |
| 2,068,547 | 1/1937 | Jung . | |
| 2,115,993 | 5/1938 | Kranhold . | |
| 2,424,432 | 7/1947 | Bower . | |
| 2,495,687 | 1/1950 | Belmont . | |
| 2,502,275 | 3/1950 | Perlin . | |
| 2,535,455 | 12/1950 | Reilly . | |
| 2,558,382 | 6/1951 | Previdi . | |
| 2,604,133 | 7/1952 | Knee . | |
| 2,623,566 | 12/1952 | Kibler . | |
| 2,681,296 | 6/1954 | Dobbs et al. . | |
| 2,717,620 | 9/1955 | Renz . | |
| 2,730,153 | 1/1956 | Miller et al. . | |
| 2,734,584 | 2/1956 | Spooner . | |
| 2,778,397 | 1/1957 | Carrasco . | |
| 2,825,208 | 3/1958 | Anderson | 150/106 |
| 3,116,773 | 1/1964 | Kikas . | |
| 3,351,064 | 11/1967 | Cohn . | |
| 4,421,127 | 12/1983 | Geer | 206/581 |
| 4,518,275 | 5/1985 | Rauch et al. | 402/80 |
| 4,580,667 | 4/1986 | Herwood . | |
| 4,588,321 | 5/1986 | Egly . | |
| 4,718,524 | 1/1988 | Crumley . | |
| 4,720,012 | 1/1988 | Dufour . | |
| 4,901,899 | 2/1990 | Barrett . | |
| 4,925,029 | 5/1990 | Friedman et al. . | |
| 5,005,697 | 4/1991 | Jimbo et al. | 206/235 |
| 5,020,673 | 6/1991 | Adams . | |
| 5,024,361 | 6/1991 | Flowers . | |
| 5,046,620 | 9/1991 | Barabino . | |
| 5,095,924 | 3/1992 | Stanfield . | |
| 5,193,681 | 3/1993 | Lievsay . | |
| 5,358,101 | 10/1994 | Lombardi | 206/581 |
| 5,441,153 | 8/1995 | Lahaye | 206/581 |
| 5,489,021 | 2/1996 | Wallingford | 206/214 |
| 5,501,326 | 3/1996 | Shuhsiang . | |
| 5,522,508 | 6/1996 | Pesola | 206/579 |
| 5,579,916 | 12/1996 | Manko . | |

FOREIGN PATENT DOCUMENTS

| | | |
|---|---|---|
| 1-160917 | 11/1989 | Japan . |

*Primary Examiner*—Paul T. Sewell
*Assistant Examiner*—Nhan T. Lam
*Attorney, Agent, or Firm*—Kenyon & Kenyon

[57] ABSTRACT

The present invention relates to a cosmetics case including a front cover, a back cover, a connecting member coupling the front cover to the back cover. A binder member is situated on at least one of the connecting member, the front cover and the back cover. The binder member includes at least one holder, with the at least one holder detachably coupling at least one cosmetic holder insert to the binder member.

3 Claims, 9 Drawing Sheets

COSMETICS CASE

FIELD OF THE INVENTION

The present invention relates to the field of carrying cases, and particularly to a cosmetics case.

BACKGROUND INFORMATION

Historically, cosmetics cases have been used to transport and store various types of cosmetics such as blush, powder, lipstick, etc. Although various conventional cosmetics case designs are currently available, a common shortcoming of these conventional designs is that the cosmetics case cannot be modified to accommodate a customer's personal needs. In other words, conventional cosmetics case designs have a predetermined number, size, and layout of compartments that are fixed at the time of manufacture and cannot be subsequently modified by the owner. As a result, the designers have taken two conventional approaches to address such shortcomings. The first conventional approach is to design a relatively limited number of cosmetics cases with generically configured compartments accommodating the broadest range of cosmetics. The second conventional approach is to provide a predetermined case design for specific cosmetic items, and thus to provide a broad range of such conventional cosmetics cases. Neither of these conventional approaches provides the customer with any degree of preferable individualized customization.

SUMMARY OF THE INVENTION

According to the present invention, a cosmetics case is provided which allows for a customizable cosmetics holder arrangement having a front cover, back cover, a connecting member, and a binder member. In an exemplary embodiment, the binder member detachably receives cosmetics holder inserts having various customizable arrangements of cosmetics compartments. In a further exemplary embodiment, cosmetics holder inserts may be detachably received on the front cover and/or the back cover.

Each holder insert may be individually customized for a specific number, size, and layout of compartments to accommodate specific cosmetic items. This allows a single cosmetics bag to be used with a vast array of items. The customer may remove and add new inserts to optimize the carrying capacity of the cosmetics case in accordance with the customer's changing needs. In an alternative embodiment, the holder insert may be further customized to accept other items such as feminine hygiene products.

DETAILED DESCRIPTION

Figure 1:
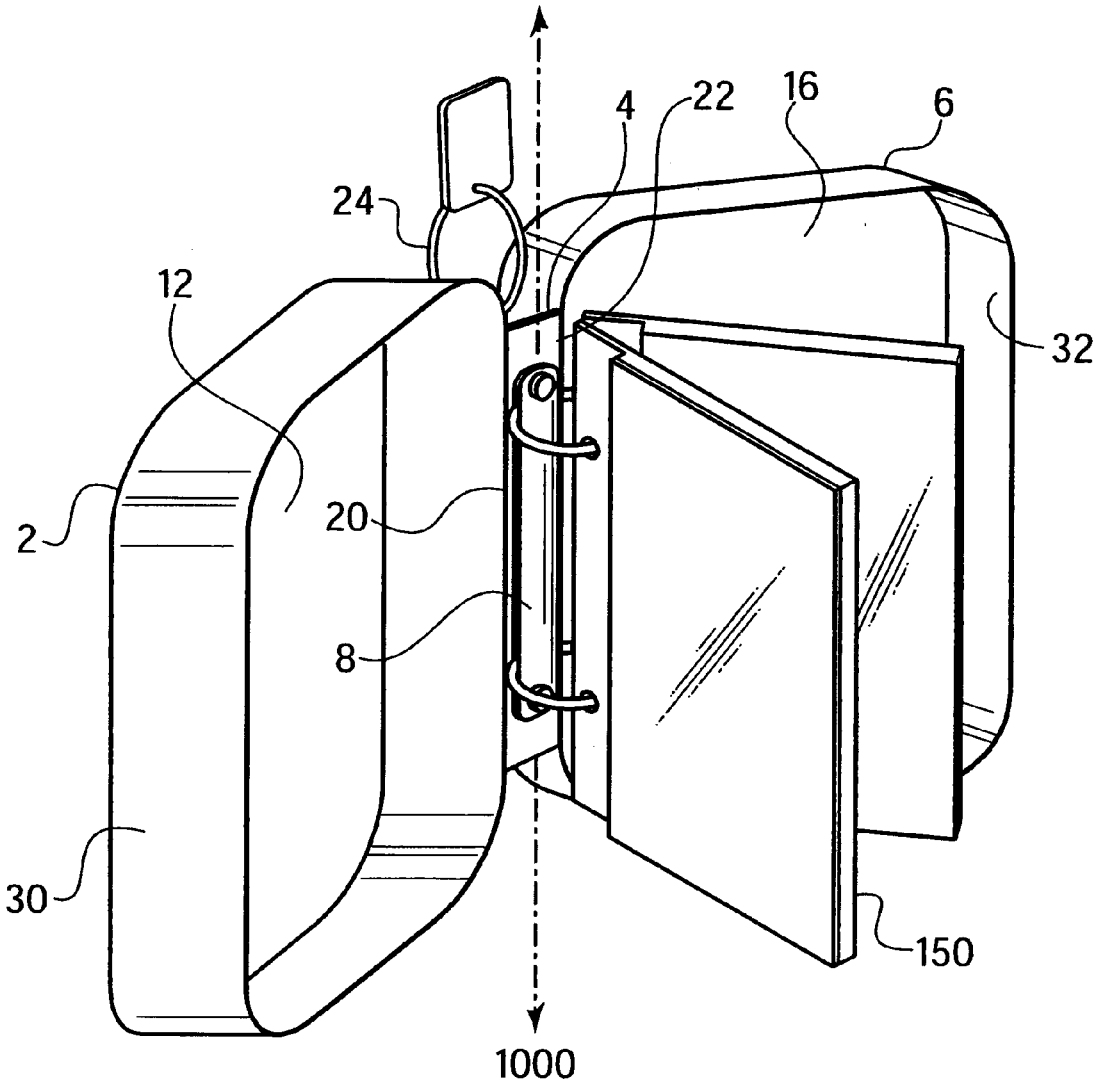
FIG. 1 illustrates an exemplary embodiment of a cosmetics case according to the present invention.
Figure 9:
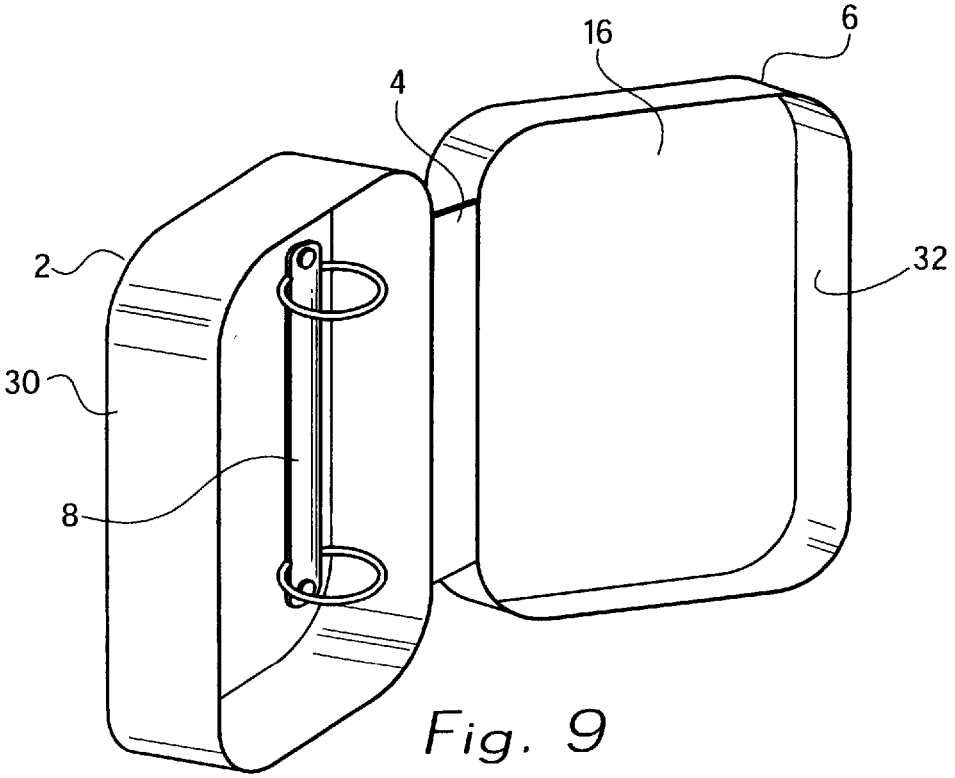
FIG. 9 illustrates an alternative arrangement of a binder spine on the cosmetics case of FIG. 1.
Figure 10:
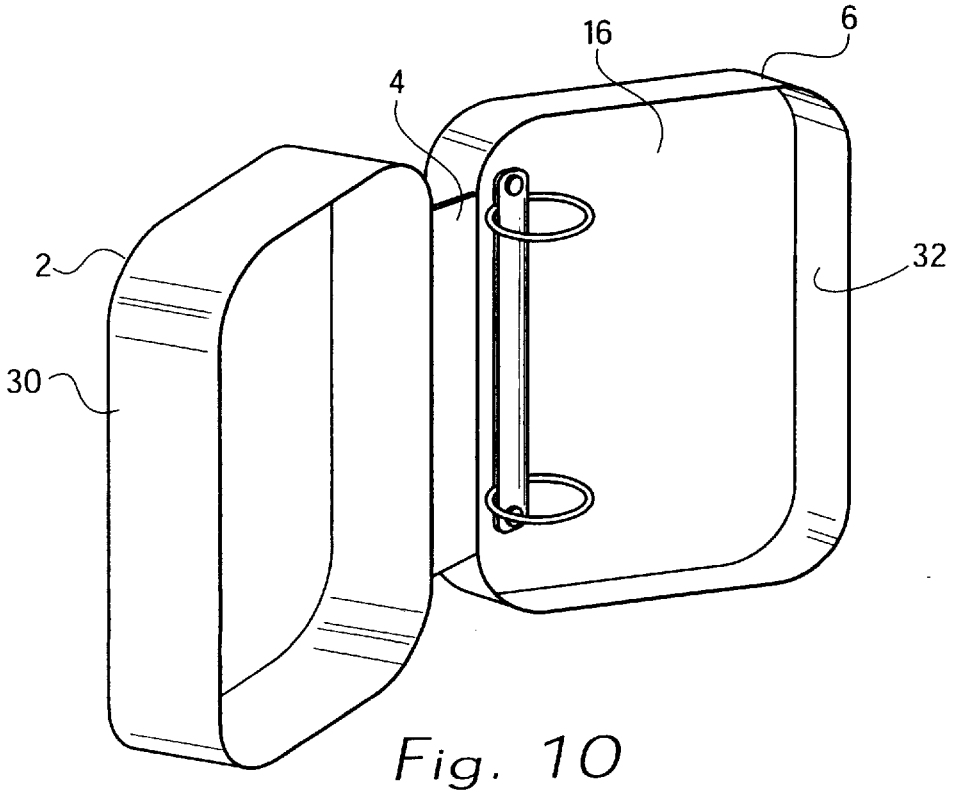
FIG. 10 illustrates a further alternative arrangement of the binder spine on the cosmetics case of FIG. 1.

FIG. 1 shows a first embodiment of a cosmetics case 1 according to the present invention. The cosmetics case 1 includes a front cover 2, a back cover 6, a connecting member 4 connecting the front cover 2 to the back cover 6, and a binder spine 8 connected to connecting member 4. It is also possible for binder spine 8 to be situated in other locations of the cosmetics case 1. For example, binder spine 8 may also be mounted directly on any portion of the front cover 2 or the back cover 6 as shown in FIGS. 9 and 10.

For the first embodiment illustrated in FIG. 1, the front cover 2 and the back cover 6 may have a substantially rectangular shape with rounded corners. The front cover 2 may have a substantially flat exterior surface 10 and a substantially flat interior surface 12. The back cover 6 may also have a substantially flat exterior surface 14 and a substantially flat interior surface 16. The front cover 2 and the back cover 6 are may be constructed from a semi-rigid material such as, for example, vinyl, or cardboard so that the front and back covers 2, 6 retain their respective shapes under a moderate pressure. It is also possible for the front cover 2 and/or the back cover 6 to be formed by wrapping a soft material around a semi-rigid or completely rigid insert which provides the structural support and shape for the respective front cover 2 and/or the back cover 6.

Figure 8:
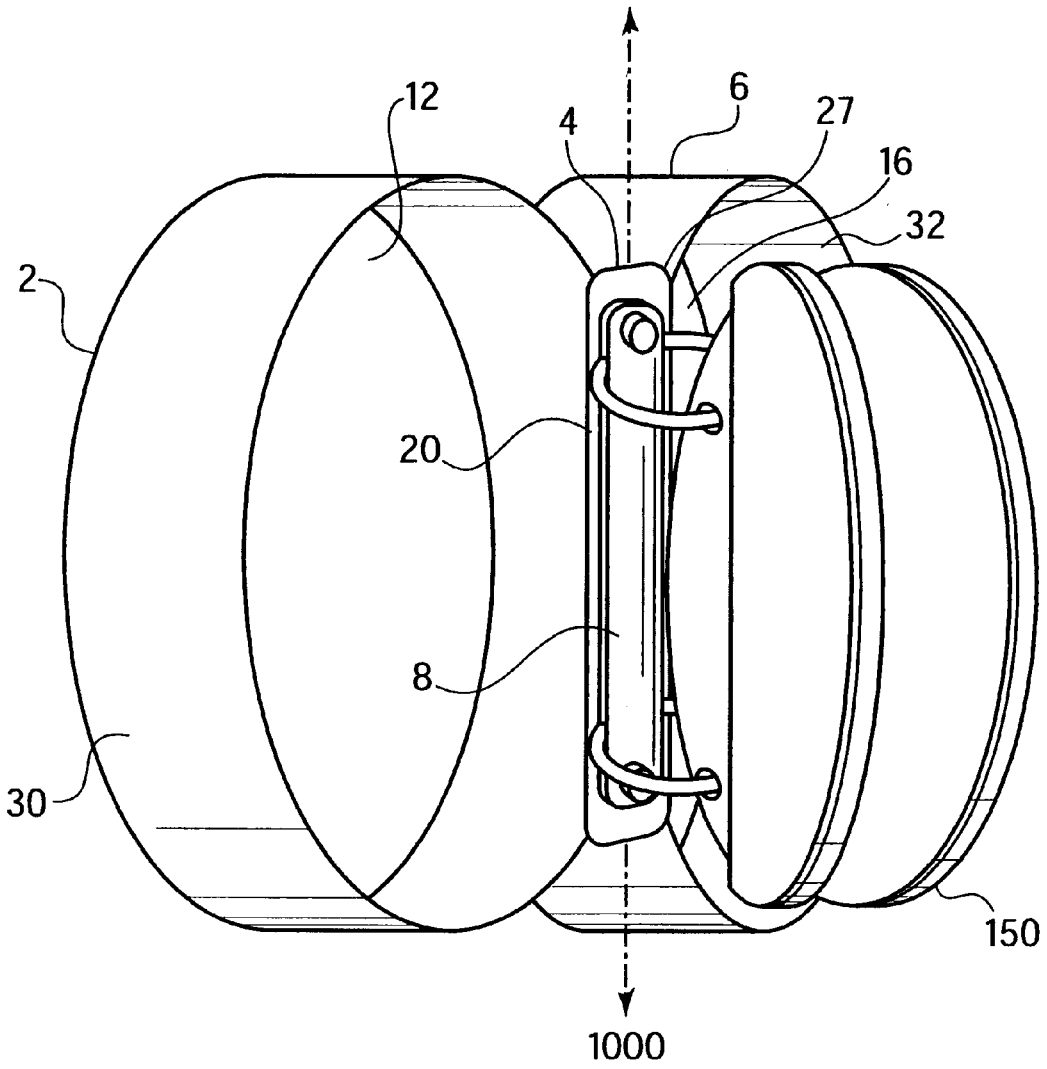
FIG. 8 illustrates an alternative embodiment of a cosmetics case according to the present invention.

The shape of the front cover 2 and the back cover 6 is not limited to the rectangular shape as described above, and may include any shape as based on various considerations such as aesthetics, or design constraints from other factors (i.e., the size and forms of specific cosmetic items). For example, another exemplary embodiment may include front and back covers having a circular shape as shown in FIG. 8. Those skilled in the art will understand that the shape and size of the front cover 2 and the back cover 6 may also be dissimilar depending on various considerations (such as design constraints or aesthetics).

Figure 2:
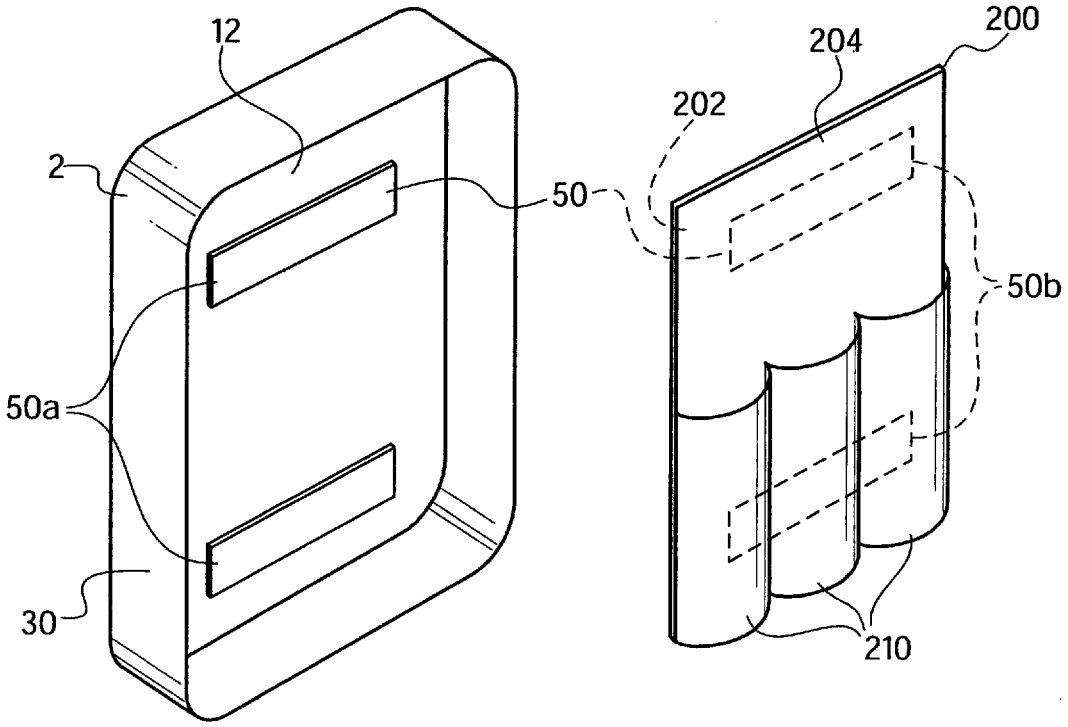
FIG. 2 illustrates an exemplary embodiment of a cover insert that is detachably connected to a front cover of the cosmetics case.

As shown in FIG. 2, the front cover 2 is preferably capable of situating a cover insert 200 thereon. Accordingly, at least one first fastening member 50*a* of a first fastening assembly 50 is provided on the interior surface 12 of the front cover 2. At least one complementary second fastening member 50*b* of the first fastening assembly 50 is provided on a back surface 202 of the cover insert 200, so that the cover insert 200 may be securely and removably fastened to the interior surface 12 of the front cover 2. The first fastening assembly 50 may be a Velcro® strip system in which Velcro® strips are provided on the bottom and top sides of the interior surface 12. Of course, those skilled in the art will understand that other types of fastening devices may be used as the first fastening assembly 50 (e.g., snaps, zipper, hook and eye, etc.).

An exemplary customizable arrangement of a cosmetics holders 210 may be provided on a front surface 204 of the cover insert 200 for holding various cosmetic items. Various arrangements of the cosmetics holders 210 for the cover insert 200 may be provided on the front surface 204 to accommodate different numbers, sizes, shapes and types of the cosmetics holders 210. In addition, a further cover may be provided over the front surface 204 to prevent the cosmetic items from falling out. The cover insert 200 may be made of either a rigid material, such as plastic, or a soft material such as a fabric mesh.

The interior surface 16 of the back cover 6 is capable of providing a substantially similar arrangement as described above with respect to the interior surface 12 of the front cover 2 to accommodate additional cover inserts, thereby providing additional storage capability.

As further shown in FIG. 1, the connecting member 4 has a substantially elongated shape and is flexibly connected to a first edge 20 of the front cover 2 and to a second edge 22 of the back cover 6, to provide a hinge-type connection between the front cover 2 and the back cover 6. Such a configuration allows the front cover 2 and the back cover 6 to swivel about a predetermined axis 1000 around the connecting member 4 between a first (closed) configuration in which the front cover 2 and the back cover 6 extend substantially along the same plane with the binder spine 8, and a second (opened) configuration in which the front cover 2 and the back cover 6 extend along different planes so as to provide access to interior portions of the cosmetics case 1.

A first side wall 30 extends substantially perpendicular with respect to the interior surface 12 of the front cover 2, and continues around the edges of the front cover 2, thereby enclosing the interior surface 12. A second side wall 32 extends substantially perpendicular to the interior surface 16 of the back cover 6, and continues around the edges of the back cover 6, thereby enclosing interior surface 16.

Figure 3:
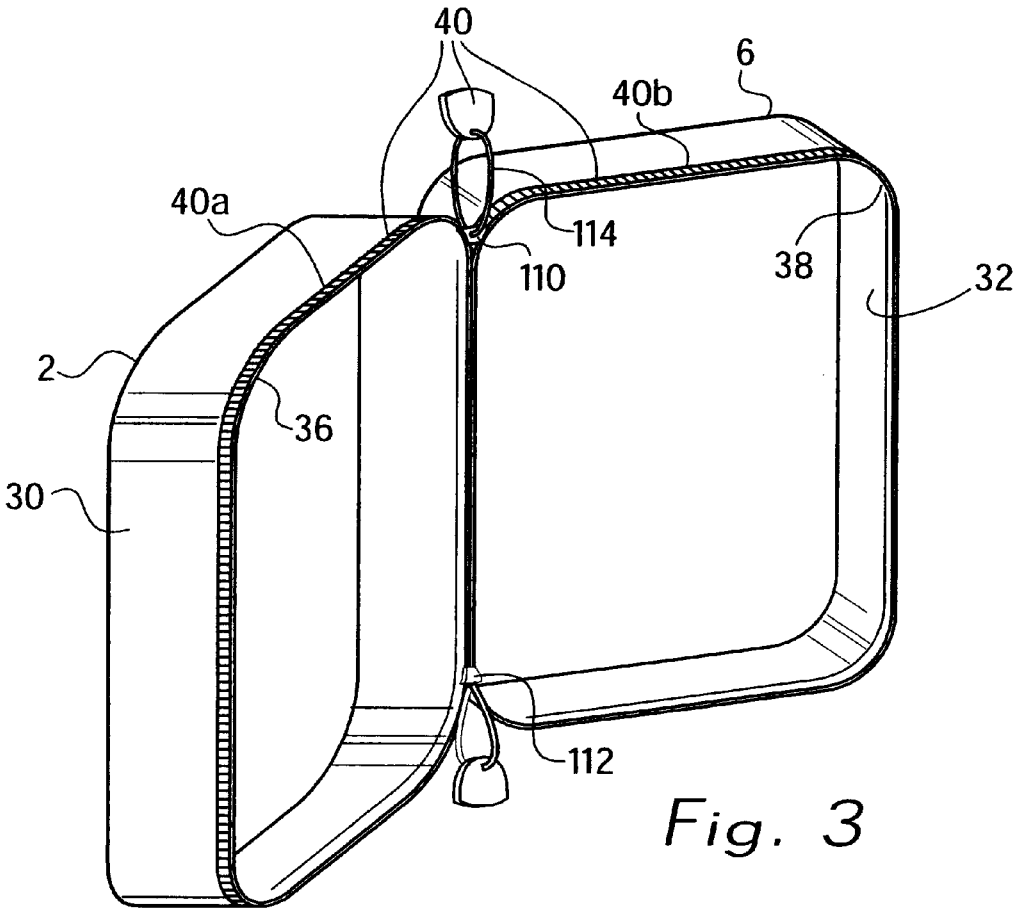
FIG. 3 illustrates a fastening arrangement for the cosmetics case shown in FIG. 1.

As shown in FIG. 3, a first fastening member 40*a* of a second fastening assembly 40 is arranged on an interior edge 36 of the first side wall 30. A complementary second fastening member 40*b* of the second fastening assembly 40 is arranged on an interior edge 38 of the second side wall 32. In operation, the first fastening member 40*a* engages with the second fastening member 40*b* to securely hold the front cover 2 and the back cover 6 in the first (closed) configuration. Thus such undesirable incidents such as, for example, dirt entering into the cosmetics case 1, or cosmetic items (or other items) falling out from the cosmetics case 1 are prevented.

Figure 4:
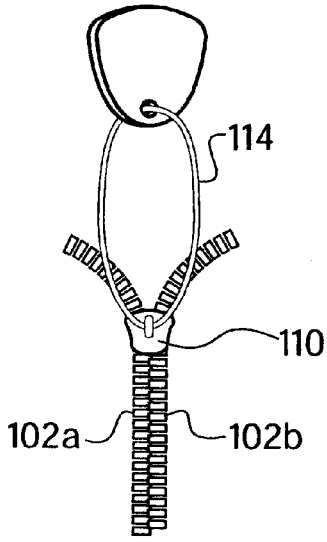
FIG. 4 illustrates a further view of the fastening arrangement shown in FIG. 3.

In the first embodiment according to the present invention, the second fastening assembly is a zipper as shown in FIG. 4. Since the design and function of zippers are well known to those skilled in the art, the zipper will not be described in extensive detail herein. In this embodiment, the first fastening member 40*a* includes a first strip of teeth 102*a* arranged along the interior edge 36 of the front cover 2, and the second fastening member 40*b* includes a second strip of teeth 102*b* arranged along the interior edge 38 of the back cover 6. As shown in FIG. 3, a first activating head 110 and a second activating head 112 are provided to engage the first strip of teeth 102*a* with the second strip of teeth 102*b* in the first (closed) configuration, and to disengage the first strip of teeth 102*a* from the second strip of teeth 102*b* in a second (opened) configuration. The activating head 110 may be provided with a handle 114 to facilitate an easily graspable means of advancing the activating head 110 along the first and second strips of teeth 102*a*, 102*b*. A substantially similar arrangement is provided for the activating head 112. Those skilled in the art will understand that other fastening devices may be used for the second fastening device 40 such as, for example, a clasp, Velcro® strip system, snaps, etc.

Figure 5A:
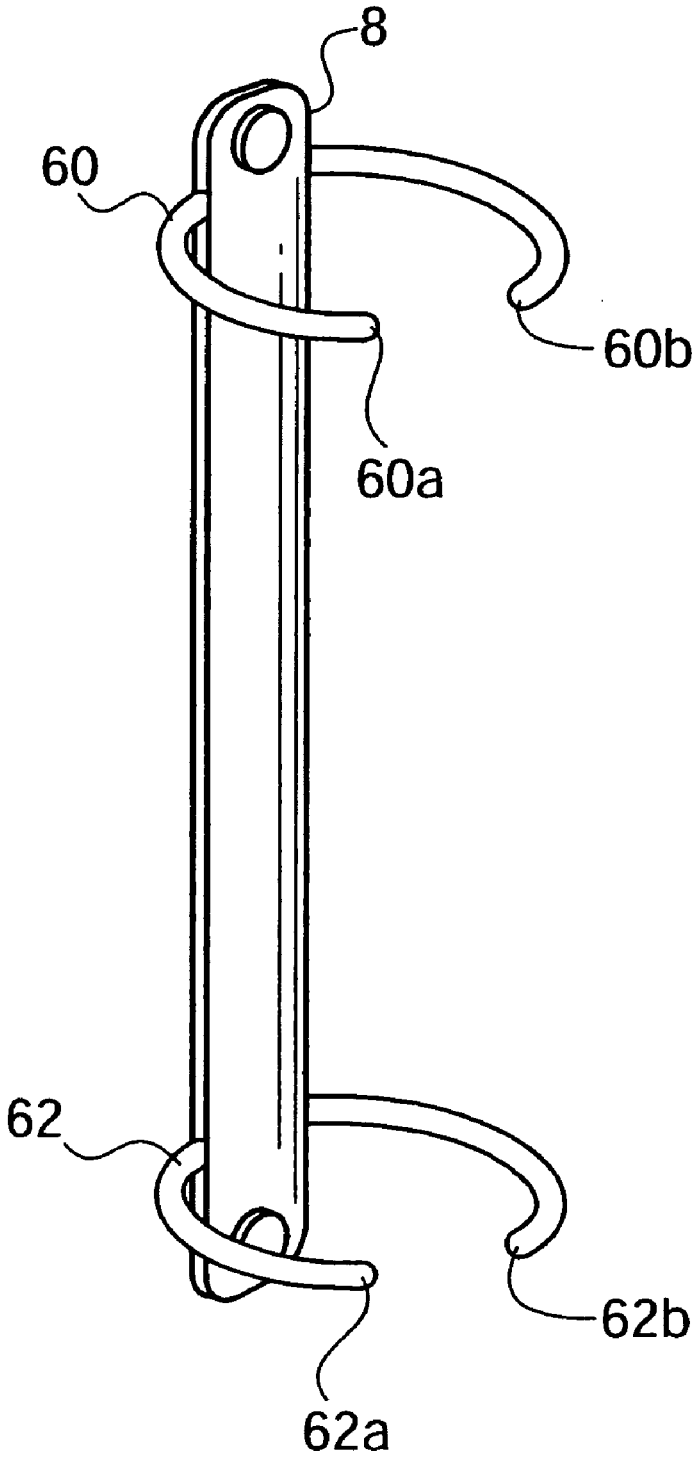
FIG. 5*a* illustrates an exemplary spine member of the cosmetics case.

As shown in FIG. 1, the binder spine 8 of the cosmetics case 1 is connected to an interior surface 4*a* of the connecting member 4 and extends along the predetermined axis 1000. As shown in FIG. 5*a*, the binder spine 8 includes at least two ring holders 60, 62. The first ring holder 60 is positioned at a predetermined distance from the second ring holder 62 along the binder spine 8. Of course, it is possible for the binder spine 8 to include more than the two ring holders 60, 62. The first ring holder 60 is separable so that a first end 60*a* is separated from a second end 60*b* in a first receiving configuration (i.e., capable of receiving inserts), and the first end 60*a* contacts the second end 60*b* in a second holding configuration (i.e., the inserts are maintained in the cosmetics case 1). The ring holder 62 is configured in a substantially similar manner. Various mechanisms are known for moving the ring holders 60, 62 between the first receiving configuration and the second holding configuration. In a preferred embodiment however, the mechanism of the binder spine 8 moves the ring holders 60, 62 substantially simultaneously between the first and second configurations. In a preferred embodiment according to the present invention, the ring holders 60, 62 have a substantially circular shape. However, those skilled in the art will understand that other shapes may also be used (e.g., substantially rectangular or partially circular/partially rectangular shapes, etc.).

Figure 5B:
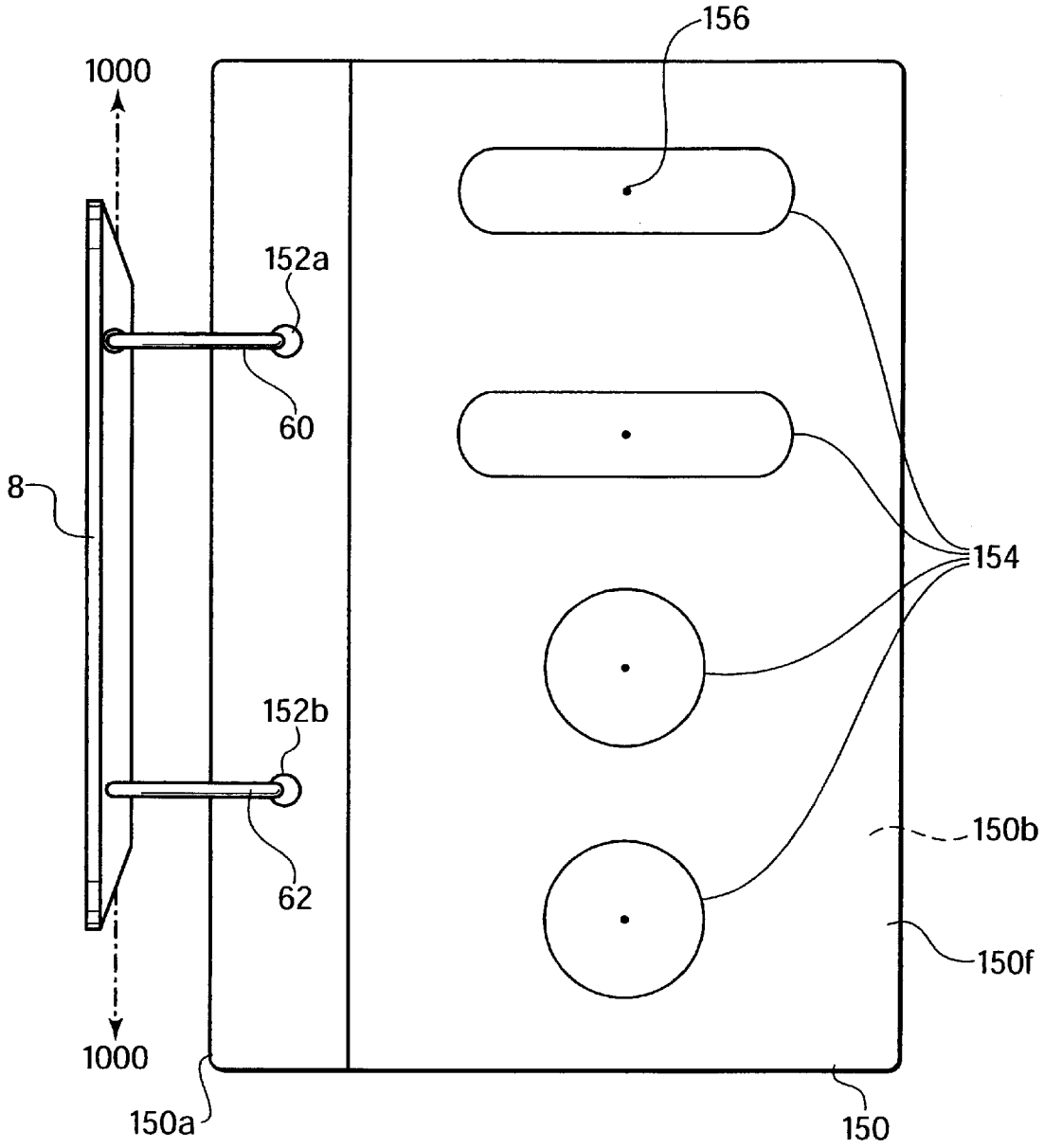
FIG. 5*b* illustrates a cosmetics holder sheet insert detachably coupled to the binder spine shown in FIG. 5*a*.

As shown in FIG. 5*b*, the holder sheet insert 150 may have a plurality of ring holes 152*a*, 152*b* corresponding in number to the number of ring holders 60, 62, and receivable by the ring holders 60, 62. The ring holes 152*a*, 152*b* are substantially similar in size to the cross-sectional size of ring holders 60, 62. The ring holes 152*a*, 152*b* are also distanced at a predetermined distance from one another along a first edge 150*a* on the holder sheet insert 150. This predetermined distance substantially corresponds to the predetermined separation between the ring holder 60 and the ring holder 62. As such, the holder sheet insert 150 may be received by ring holders 60, 62 when the ring holders 60, 62 are in the first receiving configuration. In the second holding configuration, the first and second ends 60*a*, 60*b* of the ring holders 60, 62 are in contact to maintain the holder sheet insert 150 in the cosmetics case 1 when the cosmetics case 1 is in the first closed orientation. Furthermore, the holder sheet insert 150 is removable from the ring holders 60, 62 when the ring holders 60, 62 are biased into the first receiving configuration.

The holder sheet insert 150 may preferably have a shape substantially corresponding to the shape of the front cover 2 and/or the back cover 6, although other shapes are conceivable based upon various considerations such as aesthetics or design constraints. The holder sheet insert 150 may preferably be made from a rigid material such as, for example, plastic or acrylic. As shown in FIG. 5*b*, a plurality of receiving compartments 154 may be provided on a front side 150*f* of the holder sheet insert 150 for receiving various cosmetic items. The number, size, shape and layout of the plurality of receiving compartments 154 on the holder sheet insert 150 can be customizable, and limited only by the shape and size (including width) of the holder sheet insert 150. As such, a large number of configurations are possible to accommodate many different types of cosmetic items. In addition, a magnetic member may be provided in the plurality of receiving compartments 154 to detachably maintain the cosmetic items therein. As such, the holder sheet insert 150 can be reusable. That is, even when the use of the cosmetic items is exhausted, they are removed from the corresponding receiving compartment 154, and new cosmetic items are situated in this corresponding receiving compartment 154.

An access hole 156 extends through a back side 150*b* of the holder sheet insert 150 and extends to a respective receiving compartment 154. This access hole 156 may be placed within each one of the plurality of receiving compartments 154 so that a pointed instrument (e.g., a pen) may be inserted into the access hole 156 from the back side 150*b* to remove a cosmetic item from within its respective receiving compartment 154.

Figure 6:
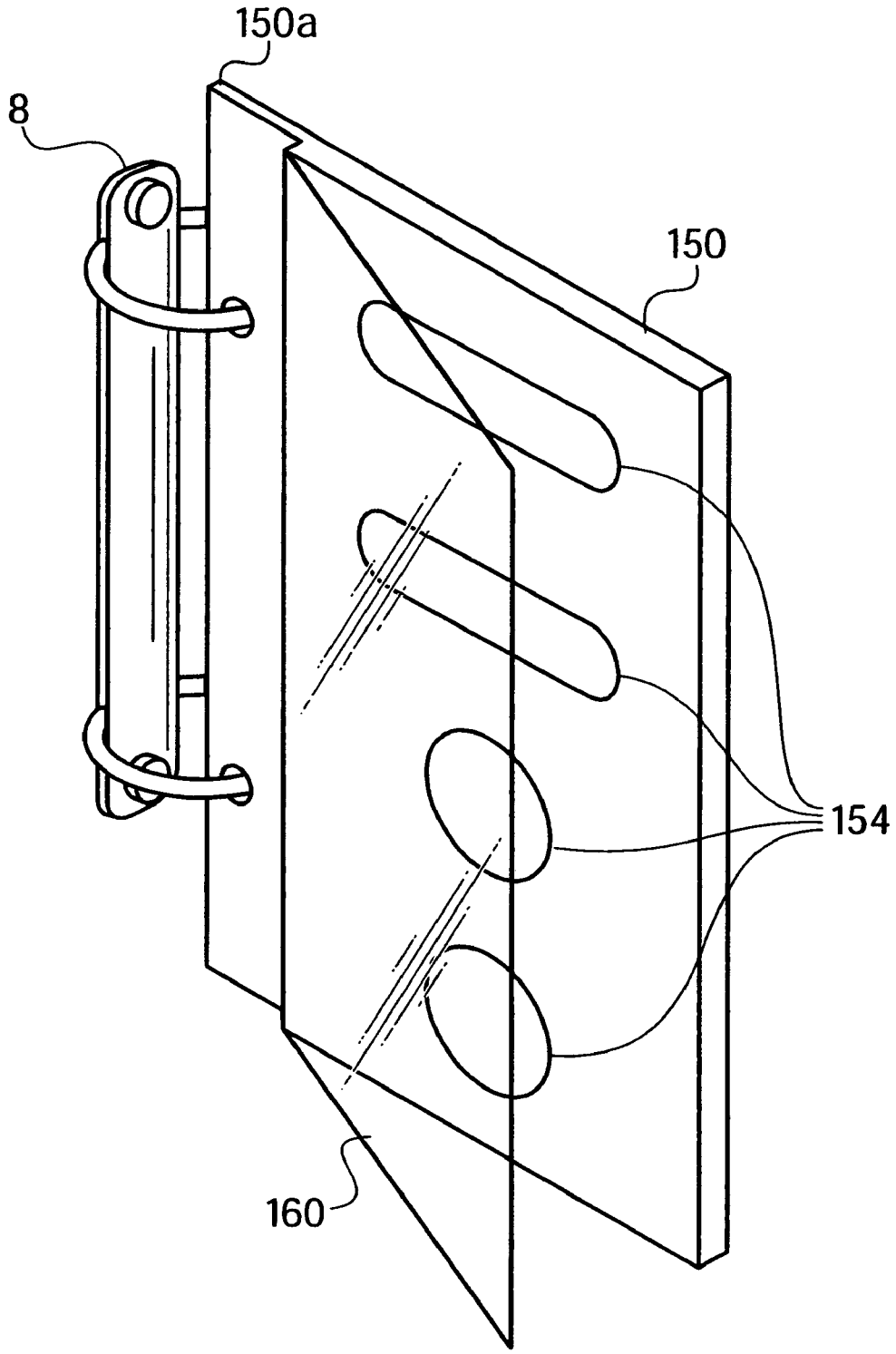
FIG. 6 illustrates an exemplary cosmetics holder sheet insert connected to a clear shield using a hinge.

A clear rigid shield 160, shown in FIG. 6, may be hingedly connected along an area adjacent to the first edge 150*a* on the front side 150*f* of the holder sheet 150, so that the shield 160 can be rotatably swiveled away or towards the front side 150*f* of the holder sheet 150. In a first closed configuration, the shield 160 may be positioned substantially at the holder sheet 150 (e.g., parallel to the holder sheet), thereby protecting the cosmetic items in the receiving compartments 154 from external contaminants or from being spilling out. Since the shield 160 is made of a clear material, the cosmetic items are still visible through the shield 160 even when the shield 160 is in the first closed configuration. In a second open configuration, the shield 160 is rotatably swiveled away from the holder sheet 150, thus allowing access to the cosmetic items in the plurality of receiving compartments 154.

Figure 7:
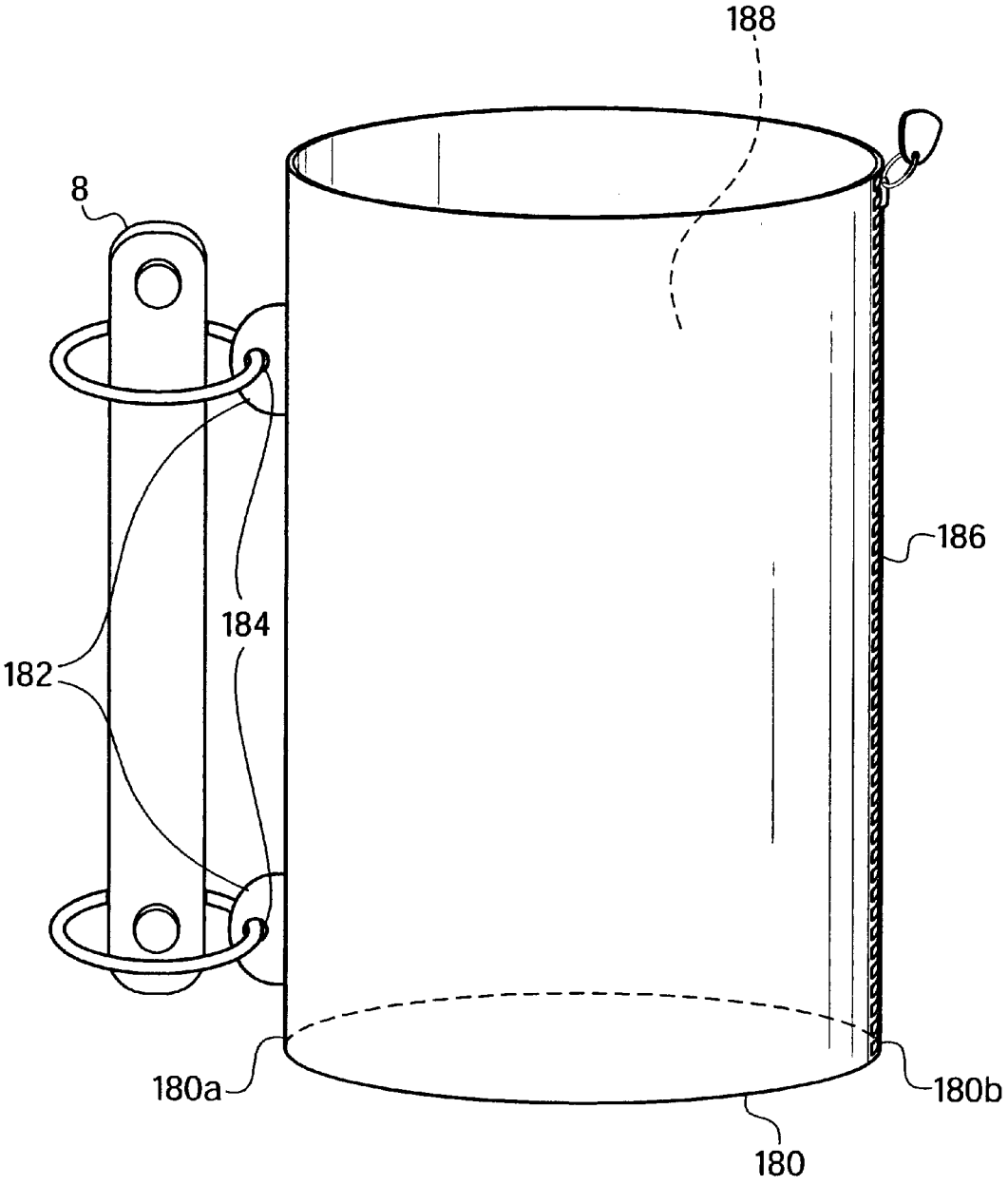
FIG. 7 illustrates a pouch insert detachably coupled to the binder member.

The ring holders 60, 62 may also receive a pouch insert 180, shown in FIG. 7, having a plurality of ring flaps 182 corresponding to the number of the ring holders 60, 62. The ring flaps 182 may have a plurality of ring holes 184 substantially corresponding in size to the cross-sectional size of the ring holders 60, 62, and the ring flaps 182 may be arranged along a first edge 180*a* of the pouch insert 180 so that the distance between the ring holes 184 substantially corresponds to the predetermined distance between the ring holders 60, 62. Accordingly, the pouch insert 180 may be received by the ring holders 60, 62 when the ring holders 60, 62 are in the first receiving configuration, maintained within the cosmetics case 1 when the ring holders 60, 62 are in the second holding configuration, and removable from the ring holders 60, 62 when the ring holders are in the first receiving configuration.

The pouch insert 180 may preferably be formed from two layers of a soft material, such as a plastic mesh. These layers may be fixedly connected along three edges (and preferably not along a fourth edge 180*b*), thereby forming an accessible interior portion 188 of the pouch insert 180. A fastening device 186 (e.g., a zipper) is provided along the fourth edge 180*b* so that when the fastening device 186 is in a first closed configuration, the interior portion 188 is inaccessible; and when fastening device 186 is in a second opened configuration, the interior portion 188 is accessible.

Although only the holder sheet insert 150 and the pouch insert 180 have been described in the above embodiment, those skilled in the art will understand that other types of inserts having various types of compartments for holding cosmetic items may also be used for the cosmetics case according to the present invention.

Other detachable receiving systems may also be used for allowing easy attachment and detachment of the holder sheet and pouch inserts into the cosmetics case 1. For example, the binder spine 8 may be a Velcro® binder spine with complementary Velcro® strips attached to the various inserts for allowing these inserts to be attached and detached as necessary to the Velcro® binder spine. Other detachable receiving systems include snaps, hook & eye arrangements, etc. The cosmetics case 1 according to the present invention may also be customized by designing the cover insert 200, the pouch insert 180, and the holder sheet inserts 150 to carry other items besides cosmetic items, such as toiletry, personal hygiene products, etc.

What is claimed is:

1. A cosmetics case, comprising:

a front cover;

a back cover;

a connecting member connected between the front cover and the back cover; and a binder member situated on at least one of the connecting member, the front cover and the back cover, the binder member including at least one holder, the at least one holder detachably coupling at least one cosmetic holder insert to the binder member wherein the cosmetic holder insert includes a cosmetic holder sheet having at least one holder compartment, wherein the cosmetic holder insert includes a back face, and wherein the at least one holder compartment includes at least one access hole extending from a front portion of the at least one holder compartment to a back portion of the at least one holder compartment.

2. A cosmetics case, comprising:

a front cover;

a back cover;

a connecting member connected between the front cover and the back cover; and a binder member situated on at least one of the connecting member, the front cover and the back cover, the binder member including at least one holder, the at least one holder detachably coupling at least one cosmetic holder insert to the binder member wherein the cosmetic holder insert includes a cosmetic holder sheet having at least one holder compartment, wherein the at least one holder compartment includes a magnetic portion to magnetically maintain a cosmetic item in the holder compartment.

3. The cosmetics case according to claim 2, wherein the cosmetic holder insert is reusable, and wherein the cosmetic item is removable from the holder compartment.

* * * * *